US010350883B2

(12) United States Patent
Yamamoto et al.

(10) Patent No.: US 10,350,883 B2
(45) Date of Patent: Jul. 16, 2019

(54) LIQUID DISCHARGE APPARATUS AND CONTROL METHOD FOR LIQUID DISCHARGE APPARATUS

(71) Applicant: CANON KABUSHIKI KAISHA, Tokyo (JP)

(72) Inventors: Ryuji Yamamoto, Ebina (JP); Hideaki Okamoto, Yokohama (JP); Junji Yasuda, Kawasaki (JP); Koji Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 15/664,291

(22) Filed: Jul. 31, 2017

(65) Prior Publication Data

US 2018/0029359 A1 Feb. 1, 2018

(30) Foreign Application Priority Data

Aug. 1, 2016 (JP) ..... 2016-151265

(51) Int. Cl.
*B41J 2/06* (2006.01)
*B41J 2/045* (2006.01)

(52) U.S. Cl.
CPC ..... *B41J 2/04541* (2013.01); *B41J 2/04505* (2013.01); *B41J 2/04525* (2013.01); *B41J 2/04526* (2013.01); *B41J 2/04543* (2013.01); *B41J 2/04576* (2013.01); *B41J 2/04586* (2013.01); *B41J 2/06* (2013.01); *B41J 2002/061* (2013.01); *B41J 2002/062* (2013.01); *B41J 2002/063* (2013.01)

(58) Field of Classification Search
CPC ..... B41J 2/06; B41J 2002/061; B41J 2002/062; B41J 2002/063; B41J 2/035; B41J 2/14; B41J 2002/14443
See application file for complete search history.

(56) References Cited

U.S. PATENT DOCUMENTS 6,123,415 A * 9/2000 Nagato ..... B41J 2/06 347/10
6,255,954 B1 7/2001 Brown

FOREIGN PATENT DOCUMENTS

| | | | |
|---|---|---|---|
| EP | 1634707 | A1 | 3/2006 |
| EP | 1674263 | A2 | 6/2006 |
| EP | 1676643 | A1 | 7/2006 |
| JP | 2001-239669 | A | 9/2001 |
| JP | 3694086 | B2 | 9/2005 |

* cited by examiner

*Primary Examiner* — Kristal Feggins
*Assistant Examiner* — Kendrick X Liu
(74) *Attorney, Agent, or Firm* — Canon USA., Inc. IP Division

(57) ABSTRACT liquid discharge apparatus includes a liquid discharge head including a plurality of electrodes arranged in parallel, a common electrode positioned to face the liquid discharge head, and a control unit configured to control a voltage to be applied to each of the plurality of electrodes to control the plurality of electrodes as a discharging electrode, which is to discharge a liquid, or as a non-discharging electrode, which is to discharge no liquid, wherein the control unit adjusts a value of the voltage to be applied to the electrode that is to be driven as the non-discharging electrode, based on the voltage to be applied to the electrode adjacent to the electrode that is to be driven as the non-discharging electrode.

6 Claims, 15 Drawing Sheets

LIQUID DISCHARGE APPARATUS AND CONTROL METHOD FOR LIQUID DISCHARGE APPARATUS

BACKGROUND OF THE INVENTION

Field of the Invention

The present disclosure relates to a liquid discharge apparatus and a control method for a liquid discharge apparatus.

Description of the Related Art

In the field of liquid discharge apparatuses such as inkjet printing apparatuses, a method called electrostatic attraction is known. In a liquid discharge apparatus using the electrostatic attraction method, force generated by an electric field formed between a printing electrode and a common electrode is used to attract liquid, and a droplet is discharged from the printing electrode toward the common electrode. In order for the liquid discharge apparatus to perform high-quality image printing, the droplet needs to land onto a desired position on a printing medium with high accuracy. However, in the liquid discharge apparatus using the electrostatic attraction method, electric fields between adjacent printing electrodes act on each other to change a potential distribution in a space where the droplet is ejected, and this causes a problem that a phenomenon of displacement of a trajectory of the ejected droplet from an ideal trajectory occurs. This phenomenon is called electric field crosstalk.

As a solution to the problem, Japanese Patent Application Laid-Open No. 2001-239669 discusses a configuration in which a conductor plate for shielding an electric field is provided between printing electrodes in order to reduce an interaction between adjacent printing electrodes. Japanese Patent No. 3694086 discusses various configurations for preventing electric field crosstalk. Specifically, Japanese Patent No. 3694086 discusses a configuration in which a grid electrode is provided between a printing electrode and a common electrode, a configuration in which a shielding electrode is provided between printing electrodes, and a configuration in which a common electrode is provided corresponding to each printing electrode.

The configuration discussed in Japanese Patent Application Laid-Open No. 2001-239669 can reduce electric field crosstalk to some extent. However, the conductor plate is shorter than the printing electrodes, so that the effect of shielding the electric field is small in leading edge portions of the printing electrodes, and the problem of displacement of the landing position of the droplet still remains.

In addition, the configurations discussed in Japanese Patent No. 3694086 have a problem that every one of the configurations is complicated.

SUMMARY OF THE INVENTION

The present disclosure is directed to a liquid discharge apparatus which employs an electrostatic attraction method and is capable of effectively reducing a displacement of a landing position from a desired position with a simple configuration, and a method of controlling the liquid discharge apparatus.

According to an aspect of the present disclosure, a liquid discharge apparatus includes a liquid discharge head including a plurality of electrodes arranged in parallel, a common electrode positioned to face the liquid discharge head, and a control unit configured to control a voltage to be applied to each of the plurality of electrodes to control the plurality of electrodes as a discharging electrode, which is to discharge a liquid, or as a non-discharging electrode, which is to discharge no liquid, wherein the control unit adjusts a value of the voltage to be applied to the electrode that is to be driven as the non-discharging electrode, based on the voltage to be applied to the electrode adjacent to the electrode that is to be driven as the non-discharging electrode.

According to another aspect of the present disclosure, a method of controlling a liquid discharge apparatus which includes a liquid discharge head including a plurality of electrodes arranged in parallel and a common electrode positioned to face the liquid discharge head and is configured discharge a liquid by generating a potential difference between the plurality of electrodes and the common electrode, the method including determining whether to drive the plurality of electrodes as a discharging electrode, which is to discharge a liquid, or as a non-discharging electrode, which is to discharge no liquid, and determining a value of a voltage to be applied to the electrode that is to be driven as the non-discharging electrode, based on a voltage to be applied to the electrode that is adjacent to the electrode that is to be driven as the non-discharging electrode.

Further features of the present disclosure will become apparent from the following description of exemplary embodiments with reference to the attached drawings.

DESCRIPTION OF THE EMBODIMENTS

Figure 1:
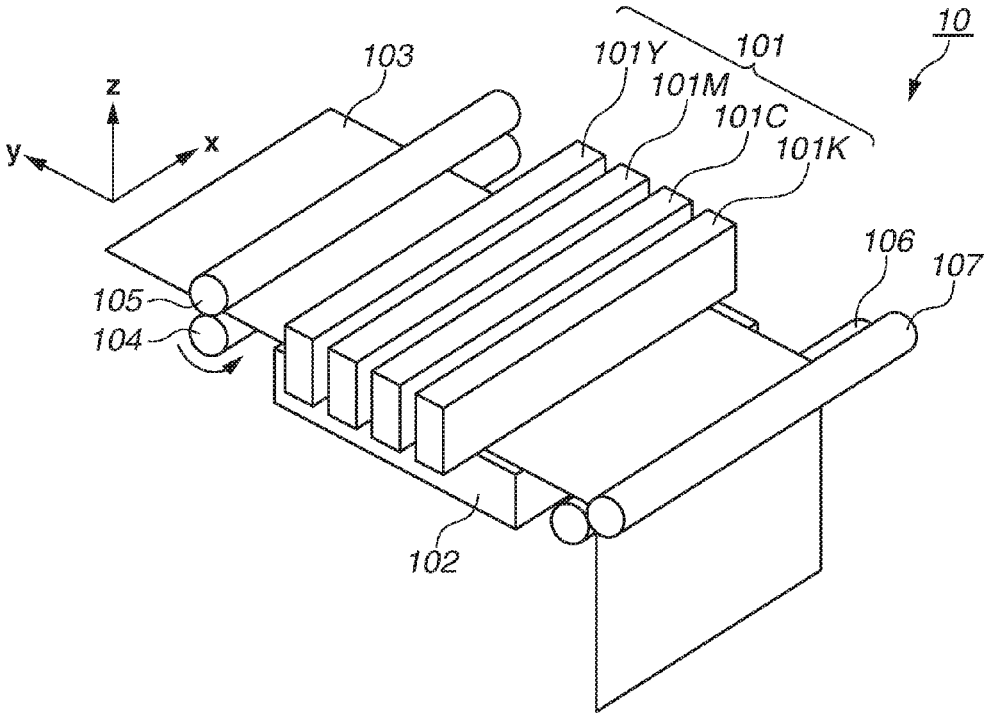
FIG. 1 schematically illustrates a configuration of a liquid discharge apparatus according to an exemplary embodiment of the present disclosure.

Various exemplary embodiments of the present disclosure will be described below with reference to the drawings. In the present specification and the drawings, components having similar functions are given the same reference numerals to sometimes omit duplicate description.

As used herein, the term "print" refers to formation of not only significant information such as characters and shapes but also insignificant information. The term "print" refers not only to visualization of information to enable a person to visually recognize the information but also more broadly to formation of an image, design, pattern, etc, on a printing medium and the processing of a medium.

The term "printing medium" refers to a sheet used commonly in printing apparatuses as well as a cloth, plastic film, metal plate, glass, ceramics, wood, leather, etc, onto which a discharged liquid such as ink can be fixed.

The term "liquid" should be interpreted broadly, like the definition of the term "print", and refers to a charge-containing liquid such as a developer agent or ink that can be used to form an image, design, pattern, etc. by being applied onto a printing medium.

<Configuration of Liquid Discharge Apparatus>

First, the configuration of a liquid discharge apparatus 10 according to a first exemplary embodiment of the present disclosure will be schematically described. FIG. 1 schematically illustrates a configuration of the liquid discharge apparatus 10. The liquid discharge apparatus 10 is an inkjet printing apparatus configured to discharge a plurality of types of ink as liquids. The liquid discharge apparatus 10 includes plurality of liquid discharge heads 101. The liquid discharge heads 101 include liquid discharge heads 101K, 101C, 101M, and 101Y, which respectively discharge black, cyan, magenta, and yellow inks. Hereinafter, the liquid discharge heads 101K, 101C, 101M, and 101Y will be referred to simply as the liquid discharge head 101 when something that is common to all the liquid discharge heads 101K, 1010, 101M, and 101Y is described or when the liquid discharge heads 101K, 101C, 101M, and 101Y do not have to be distinguished. The liquid discharge apparatus 10 further includes a common electrode 102, a printing medium conveying roller 104, an auxiliary roller 105, a printing medium feed roller 106, and an auxiliary printing medium feed roller 107. The common electrode 102 is positioned to face the liquid discharge head 101.

The printing medium feed roller 106 and the auxiliary printing medium feed roller 107 feed a printing medium 103 from a tray (not illustrated) and sandwich the printing medium 103 between the printing medium feed roller 106 and the auxiliary printing medium feed roller 107. The printing medium 103 is conveyed between the liquid discharge head 101 and the common electrode 102 and is then sandwiched between the printing medium conveying roller 104 and the auxiliary roller 105. The printing medium conveying roller 104 is rotated in the direction of an arrow to convey the printing medium 103 in the positive y-direction.

Figure 2:
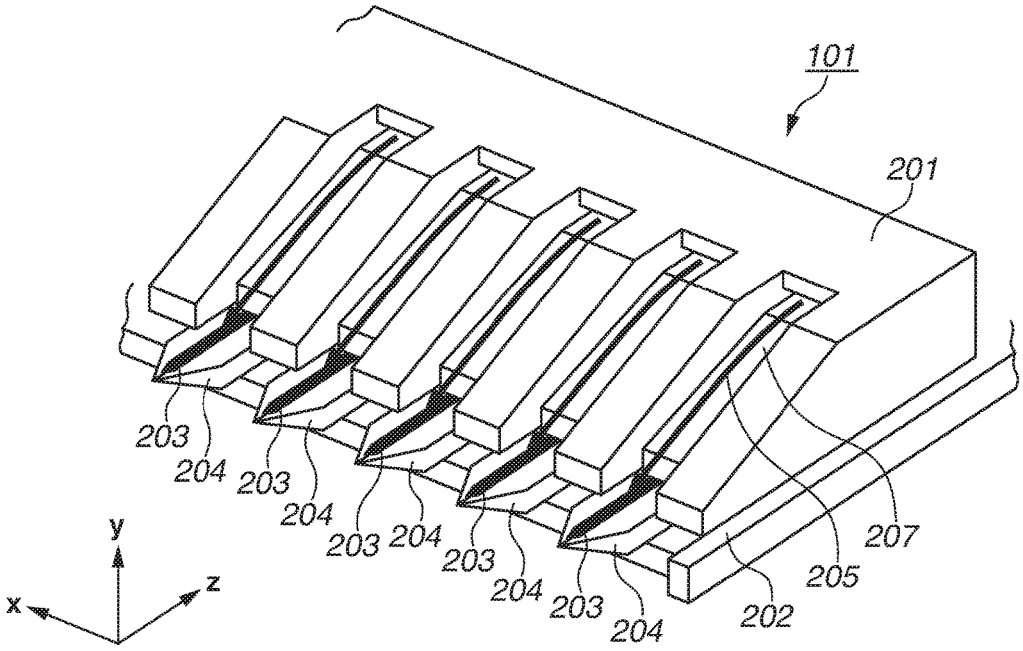
FIG. 2 is an enlarged perspective view illustrating a part of a liquid discharge head.

FIG. 2 is an enlarged perspective view illustrating a part of the liquid discharge head 101. The liquid discharge head 101 includes a flow path member 201 and a discharge substrate 202. The flow path member 201 includes a groove portion 207, and a leading edge of the discharge substrate 202 includes a plurality of comb-like discharge portions 204. The discharge portions 204 respectively include a plurality of discharge portion electrodes 203 arranged in parallel. The flow path member 201 is connected to an ink supply unit (not illustrated), and supplied ink flows through the groove portion 207 along the direction of an arrow 205 and is guided to a leading edge of the discharge portion 204. The liquid discharge head 101 is disposed such that the negative z-direction is oriented toward the common electrode 102.

Figure 3:
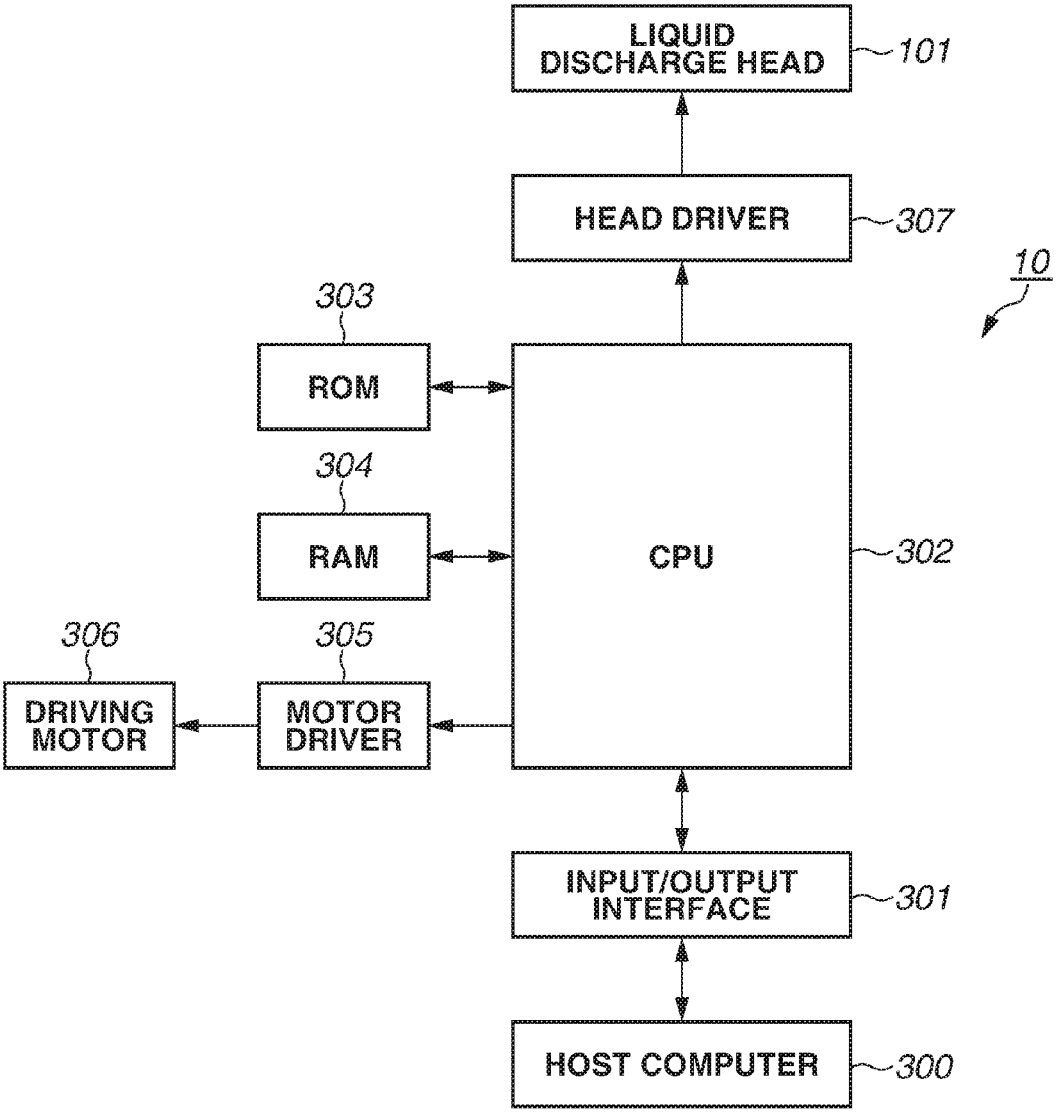
FIG. 3 illustrates a functional configuration of the liquid discharge apparatus.

FIG. 3 illustrates functional configuration of the liquid discharge apparatus 10. The liquid discharge apparatus 10 includes the liquid discharge head 101, an input/output interface 301, a central processing unit (CPU) 302, and a read-only memory (ROY) 303. The liquid discharge apparatus 10 further includes a random access memory (RAM) 304, a motor driver 305, a driving motor 306, and a head driver 307.

A host computer 300 transmits control data, such as a print instruction, and print data to be printed to the liquid discharge apparatus 10. Further, the host computer 300 receives status information, etc. from the liquid discharge apparatus 10.

The input/output interface 301 receives the control data and the print data transmitted from the host computer 300 and outputs the status information, etc. to the host computer 300.

The CPU 302 controls an entire operation of the liquid discharge apparatus 10 according to an instruction from the host computer 300. The ROM 303 is a recording device in which a control program and data such as font data are stored. The RAM 304 is a storage device used as a print buffer for temporarily storing the print data and as a work area of the CPU 302.

The motor driver 305 is a driver for driving the driving motor 306. The motor driver 305 controls driving of the driving mot 306 according to an instruction from the CPU 302. The driving motor 306 drives the printing medium conveying roller 104, the printing medium feed roller 106, etc. The head driver 307 is a driver for driving the liquid discharge head 101 and drives the liquid discharge head 101 according to an instruction output from the CPU 302.

The print data transmitted from the host computer 300 is temporarily stored in a reception buffer (not illustrated) in the input/output interface 301, converted into print data that is processable by the liquid discharge apparatus 10, and then supplied to the CPU 302. The CPU 302 reads a control program stored in the ROM 303 and executes the control program to divide the supplied print data into respective ink units and temporarily store the divided print data in the print buffer of the RAM 304. The print data stored in the print buffer of the RAM 304 is read by the CPU 302 again according to an order in which the discharge portions 204 of the respective inks are driven. Thus, the print data is output to the head driver 307 to coincide with actual discharge timing, and the corresponding liquid discharge head 101 is driven to discharge ink. In this way, the CPU 302 controls a voltage to be applied to the discharge portion electrodes 203 based on the print data.

Figure 4:
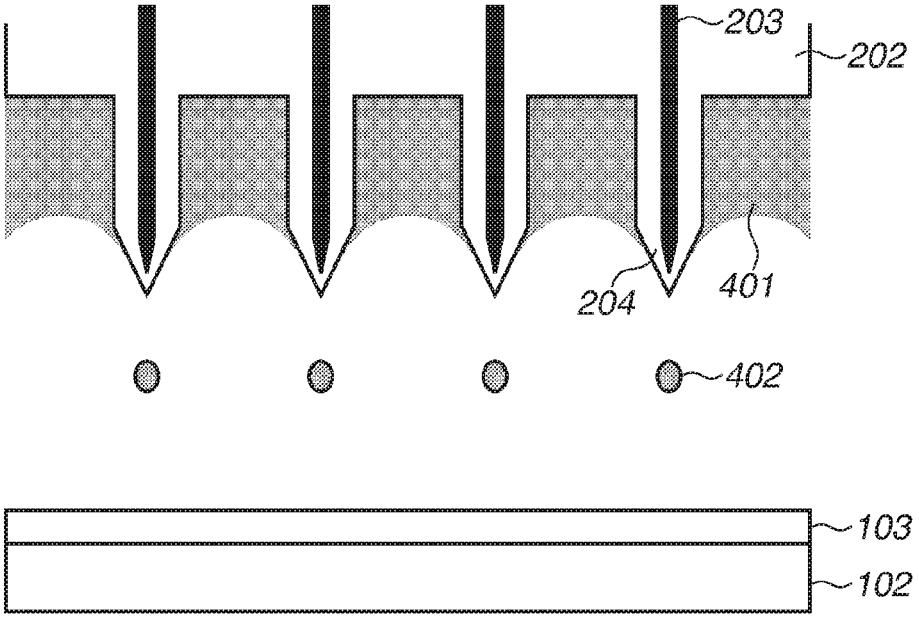
FIG. 4 illustrates a discharging mechanism in the liquid discharge apparatus.

FIG. 4 is a cross sectional view illustrating the liquid discharge head 101 in a discharge state. Ink 401 is filled between the comb-like discharge portions 204. In this state, if a potential difference is generated between the discharge portion electrodes 203 and the common electrode 102, ions in the ink 401 are attracted to the common electrode 102 by an electrostatic force. If the electrostatic force exceeds the surface tension of the ink 401, a droplet 402 is separated from the ink 401 and ejected toward the common electrode 102. Between the discharge portion electrodes 203 and the common electrode 102 is placed the printing medium 103, so that the ejected droplet 402 lands onto the printing medium 103. The ink 401 can be a high-resistance solvent with charge-retaining particles dispersed therein. This type of ink 401 is also attracted to the common electrode 102 by the electrostatic force, so that a similar advantage is produced. As described above, the liquid discharge apparatus 10 employs the electrostatic attraction method in which the liquid is discharged using the electrostatic force generated by the potential difference between the discharge portion electrodes 203 and the common electrode 102.

The liquid discharge apparatus 10 reduces electric field crosstalk by adjusting the potential difference between the common electrode 102 and each of the discharge portion electrodes 203. A suitable value of the potential difference for reducing electric field crosstalk varies depending on conditions such as the shapes of the discharge portions 204, physical properties of the ink 401, and the distance between the discharge portion electrode 203 and the common electrode 102, so the value needs to be determined for each conditions. In order to determine the potential difference for reducing electric field crosstalk, the present inventors, first, studied a value of voltage at the discharge of the ink 401 as the droplet 402. The distance between the leading edge of each of the discharge portions 204 and the printing medium 103 was 600 μm. The printing medium 103 was a metal medium. The potential of the printing medium 103 was equal to the grounded common electrode 102. In the present exemplary embodiment, the droplet 402 was discharged when the voltage applied to the discharge portion electrode 203 exceeded 1200 V. In this case, it was found that the discharge of the droplet 402 occurred in response to application of an electric field of 1200 V/600 μm=$2.0\times10^{6}$ V/m or higher. A voltage at which the electric field is generated will be referred to as a discharge threshold voltage Vt. Specifically, the discharge threshold voltage Vt is a voltage at which a liquid is dischargeable.

Next, the present inventors studied the state of discharge in a case of applying a pulsed voltage to the discharge portion electrode 203. When a voltage of 1300 V was applied to the discharge portion electrode 203 at a discharge frequency of 20 kHz, approximately 2 pl of the droplet 402 was discharged. The droplet 402 was positively charged and was considered to retain approximately $3\times10^{-13}$ C of charges based on the election speed of the droplet 402 and static electric field calculation. The voltage (>Vt) applied to the discharge portion electrode 203 and the discharge frequency were changed, but the levels of the discharge amount and the charge amount were substantially the same.

Figure 5:
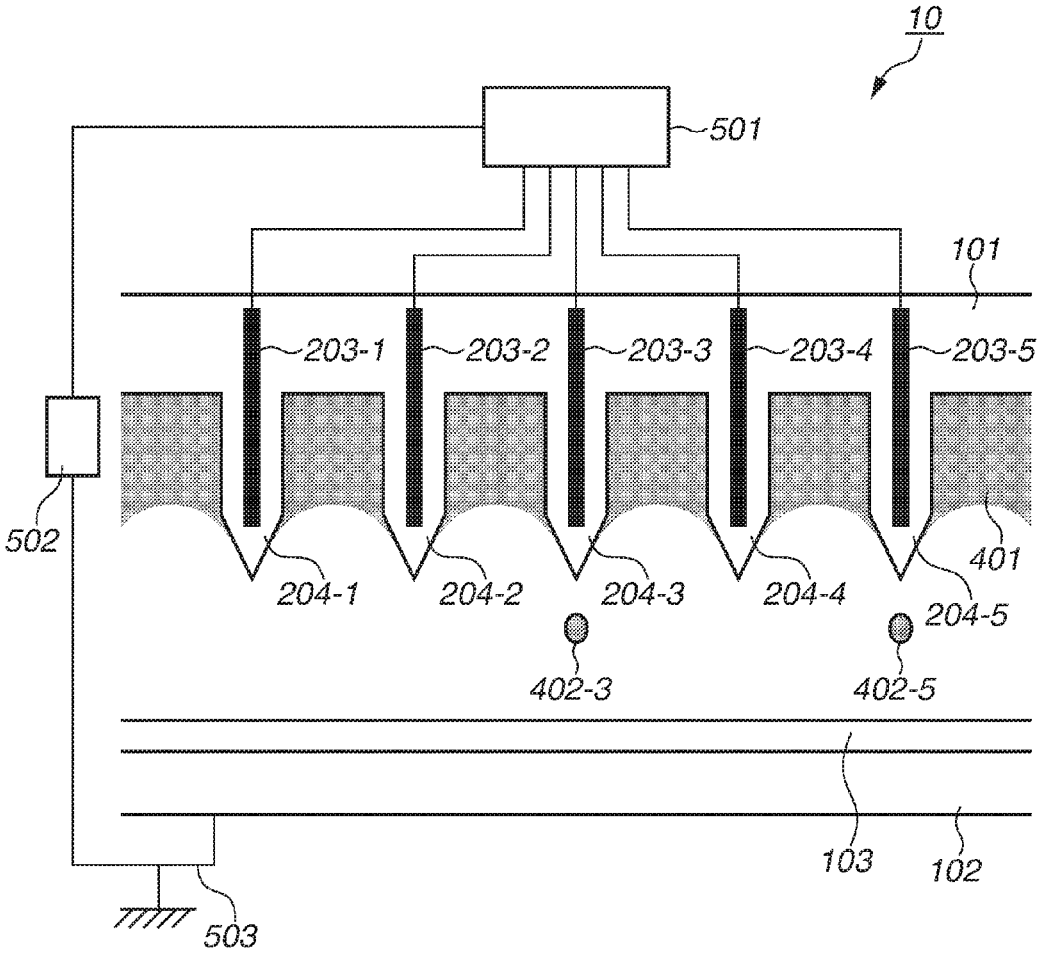
FIG. 5 illustrates a first exemplary embodiment.

FIG. 5 schematically illustrates a configuration of a part of the liquid discharge apparatus 10 according to the first exemplary embodiment of the present disclosure. To briefly describe a mechanism of reducing electric field crosstalk in the liquid discharge apparatus 10, five discharge portion electrodes 203 are illustrated in FIG. 5. Hereinafter, when the five discharge portion electrodes 203 need to be distinguished, the discharge portion electrodes 203 will be referred to as discharge portion electrodes 203-1 to 203-5, the reference numeral 203 followed by a hyphen and a number indicating the order of arrangement. When the discharge portion electrodes 203-1 to 203-5 do not need to be distinguished, the discharge portion electrodes 203-1 to 203-5 will be referred to simply as the discharge portion electrode 203. The same applies to the discharge portions 204.

The liquid discharge head 101 includes the plurality of discharge portion electrodes 203-1 to 203-5. The discharge portion electrodes 203-1 to 203-5 are printing electrodes which are to be determined to be driven as a discharging electrode, which is to discharge a liquid, or as a non-discharging electrode, which is to discharge no liquid, based on the print data. The discharge portion electrodes 203-1 to 203-5 are respectively provided in the discharge portions 204-1 to 204-5. The discharge portion electrodes 203-1 to 203-5 are connected to a controller 501. The controller 501 is a control unit configured to apply a voltage to the discharge portion electrodes 203-1 to 203-5 using power supplied from a power source 502. The common electrode 102 is provided at a position facing the liquid discharge head 101. Between the common electrode 102 and leading edges of the discharge portions 204-1 to 204-5 is placed the printing medium 103. The common electrode 102 is connected to a ground wiring 503 configured to function as a common electrode control means. The common electrode 102 has a ground potential. Thus, in the present specification, the value of the voltage applied to the electrode of the liquid discharge head 101 is the potential difference between the electrode and the common electrode 102.

In the present exemplary embodiment, the discharge frequency is 2.4 kHz, and the printing medium 103 is conveyed at a conveyance rate of 8 inch/sec. An image of 300 dpi is formed in the direction in which the printing medium 103 is conveyed. The discharge portions 204 are arranged at an arrangement density of 300 dot/inch. The width of the discharge portion electrode 203 in a column direction is 10 μm. The distance between a leading edge of the discharge portion electrode 203 and the leading edge of the discharge portion 204 is 100 μm. The distance between the leading edge of the discharge portion 204 and the printing medium 103 is 600 μm. The printing medium 103 is made of metal.

At the time of performing printing on the printing medium 103, the controller 501 determines based on the print data whether to drive each of the discharge portion electrodes 203 as the discharging electrode or as the non-discharging electrode. The controller 501 applies a voltage equal to or higher than the discharge threshold voltage Vt, e.g., a voltage of 1300 V, to the discharge portion electrode 203 that is determined to be driven as the discharging electrode. Further, the controller 501 adjusts, within values that are smaller than the discharge threshold voltage Vt, the value of the voltage to be applied to the discharge portion electrode 203 that is determined to be driven as the non-discharging electrode. In other words, in the present exemplary embodiment, a target electrode to be adjusted is an electrode among the discharge portion electrodes 203, which are the printing electrodes, that is to be driven as the non-discharging electrode. Specifically, the controller 501 adjusts the voltage to be applied to the target discharge portion electrode 203 based on the voltage to be applied to the discharge portion electrode 203 other than the target discharge portion electrode 203, e.g., the discharge portion electrode 203 adjacent to the target discharge portion electrode 203.

The controller 501 can set the potential difference between a target discharge portion electrode 203 and the common electrode 102 such that the potential difference is larger in a case where one of the two adjacent discharge portion electrodes 203 is the discharging electrode and the other one is the non-discharging electrode than in a case where both of the two adjacent discharge portion electrodes 203 are the discharging electrodes. Specifically, in the case where both of the discharge portion electrodes 203 adjacent to the target discharge portion electrode 203 are the discharging electrodes and a voltage of 1300 V is to be applied, the controller 501 sets to 900 V the value of the voltage to be applied to the target discharge portion electrode 203. In the case where one of the two discharge portion electrodes 203 adjacent to the target discharge portion electrode 203 is the discharging electrode and the other one is the non-discharging electrode, the controller 501 sets to 1100 V the value of the voltage to be applied to the target discharge portion electrode 203. Further in the case where both of the two discharge portion electrodes 203 adjacent to the target discharge portion electrode 203 are the non-discharging electrodes, the controller 501 sets to 1000 V the value of the voltage to be applied to the target discharge portion electrode 203. In a case where there is no adjacent discharge portion electrode 203, the controller 501 can handle the case as in the case where the non-discharging electrode exists. Accordingly, in a case where there is only one discharge portion electrode 203 adjacent to the target discharge portion electrode 203 and the adjacent discharge portion electrode 203 is the non-discharging electrode, the controller 501 sets to 1000 V the value of the voltage to be applied to the target discharge portion electrode 203.

For example, in the state illustrated in FIG. 5, among the discharge portion electrodes 203-1 to 203-5, the discharge portion electrodes 203-3 and 203-5 are the discharging electrodes, and the discharge portion electrodes 203-1, 203-2, and 203-4 are the non-discharging electrodes. The controller 501 applies a voltage of 1300 V to the discharge portion electrodes 203-3 and 203-5, which are the discharging electrodes. There is only one discharge portion electrode 203 adjacent to the discharge portion electrode 203-1, and the discharge portion electrode 203-2 is the non-discharging electrode, so that the controller 501 applies a voltage of 1000 V to the discharge portion electrode 203-1. Further, there are two discharge portion electrodes 203 that are adjacent to the discharge portion electrode 203-2, and the discharge portion electrodes 203-1, which is one of the two adjacent discharge portion electrodes 203, is the non-discharging electrode, and the discharge portion electrode 203-3, which is the other one of the two adjacent discharge portion electrodes 203, is the discharging electrode. Thus, the controller 501 applies a voltage of 1100 V to the target discharge portion electrode 203-2. Further, both of the two discharge portion electrodes 203-3 and 203-5 adjacent to the discharge portion electrode 203-4 are the discharging electrodes, so that the controller 501 applies a voltage of 900 V to the target discharge portion electrode 203-4.

Advantage of First Exemplary Embodiment

In the present exemplary embodiment, the value of the voltage applied to each discharge portion electrode 203 that is determined to be driven as the non-discharging electrode is adjusted based on the voltage applied to the discharge portion electrode(s) 203 adjacent to the discharge portion electrode 203 that is determined to be driven as the non-discharging electrode.

To describe an advantage of the present exemplary embodiment, the following describes a first comparative example in which the value of the voltage to be applied to the discharge portion electrode 203 that is determined to be driven as the non-discharging electrode is not adjusted. The liquid discharge apparatus 10 according to the first comparative example has a similar configuration to that according to the first exemplary embodiment illustrated in FIG. 5. The first comparative example is different from the first exemplary embodiment in the method of controlling the voltage to be applied to the discharge portion electrodes 203. Specifically, the controller 501 applies a voltage of 1300 V to the discharge portion electrode 203 that is to be driven as the discharging electrode. Further, the controller 501 applies a voltage of 1000 V to the discharge portion electrode 203 that is to be driven as the non-discharging electrode. In this way, the voltage of only the discharge portion electrode 203 that is to be driven as the discharging electrode exceeds the discharge threshold voltage Vt, and the droplet 402 is discharged from the discharge portion 204 that includes the discharge portion electrode 203. The discharged droplet 402 is attracted to the common electrode 102 and lands onto the printing medium 103. The droplets 402 having landed on the printing medium 103 form an image.

As illustrated in FIG. 5, in the case where the discharge portion electrodes 203-3 and 203-5 are to be driven as the discharging electrodes and the discharge portion electrodes 203-1, 203-2, and 203-4 are to be driven as the non-discharging electrodes, a droplet 402-3 receives a Coulomb force and is attracted to the discharge portion 204-1 side. Thus, the droplet 402-3 does not travel straight and lands onto a position displaced toward the discharge portion 204-1 side. This phenomenon leads to image defects such as white streaks.

Figure 6:
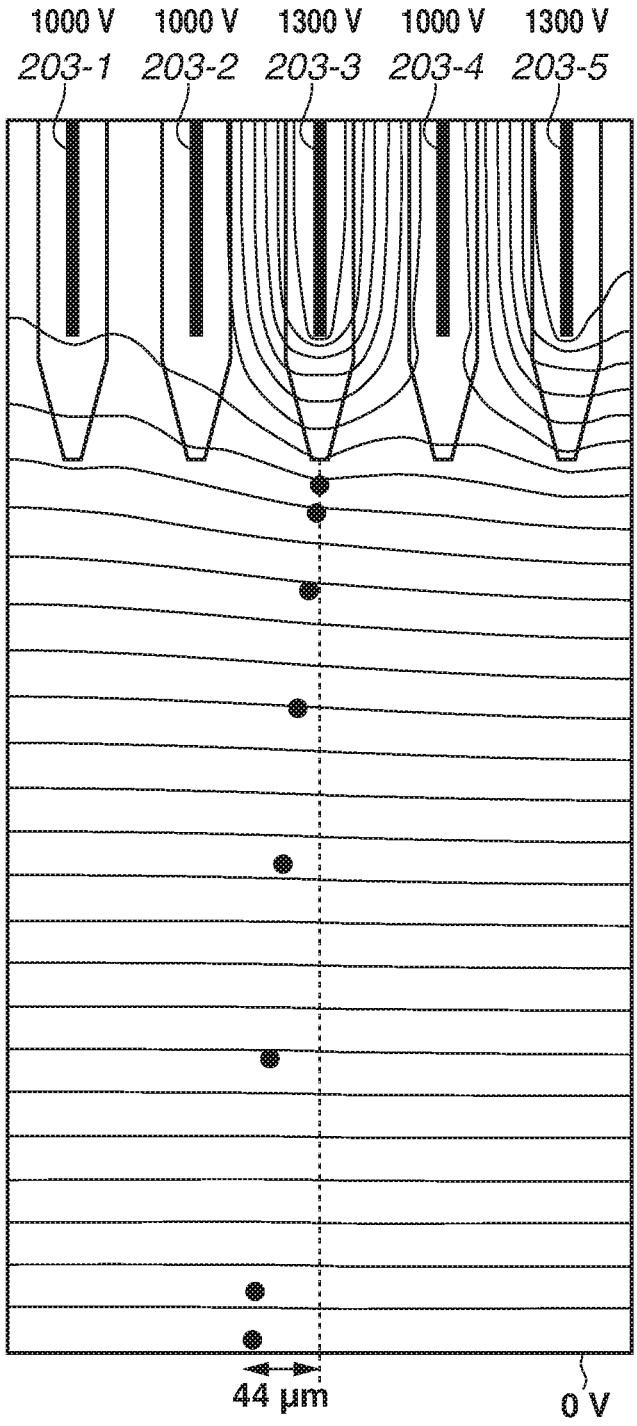
FIG. 6 illustrates a locus of a discharged droplet according to a first comparative example.

FIG. 6 illustrates a locus of the droplet 402-3 from the discharge to the landing which is obtained numerical calculation in the first comparative example. The discharge portion electrode 203 that was to be driven as the discharging electrode and the common electrode 102 were set to a fixed potential. The relative dielectric constant of an insulated portion of the liquid discharge head 101 was set to 5.0. The droplet 402-3 was a 2-pi sphere. The Coulomb force from the discharge portion electrode 203 and air resistance were taken into consideration, and a trajectory was calculated using an equation of motion. In FIG. 6, solid lines are isoelectric lines, and black circles are the droplet locus. In this case, the droplet 402-3 landed onto a position displaced by 44 μm from landing position of the droplet 402-3 having traveled straight.

Figure 7:
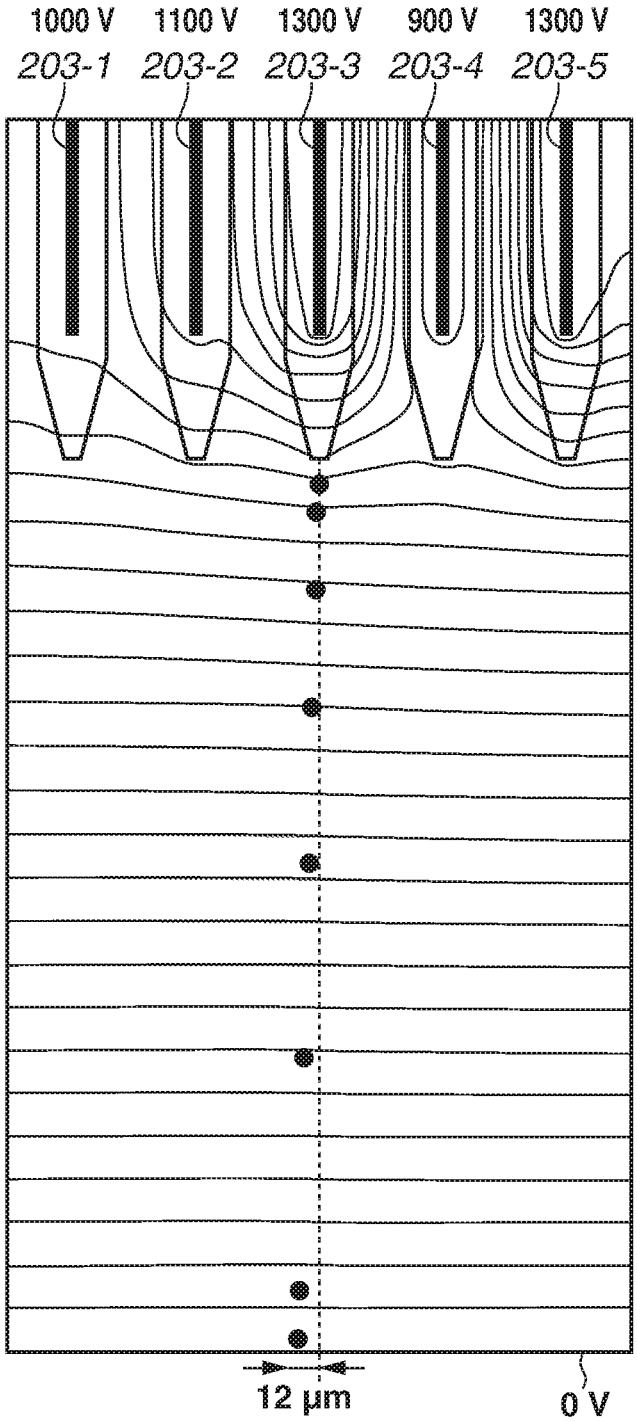
FIG. 7 illustrates a locus of a discharged droplet according to the first exemplary embodiment.

As described in the first exemplary embodiment, in the case where the voltage to be applied to the discharge portion electrode 203 that is to be driven as the non-discharging electrode is adjusted, the Coulomb forces cancel each other due to the voltage of 1100 V applied to the discharge portion electrode 203-2 and the voltage of 900 V applied to the discharge portion electrode 203-4. This is considered as a reason why that the amount of displacement of the landing position is smaller in the first exemplary embodiment than in the first comparative example. FIG. 7 illustrates a locus of the droplet 402-3 from the discharge to the landing that is calculated by numerical calculation in the present exemplary embodiment. Conditions of the calculation method, etc. are similar to those in the first comparative example. In the present exemplary embodiment, it was confirmed that the amount of displacement of the landing position was 12 μm and was smaller than the amount of displacement in the first comparative example which was 44 μm.

A second exemplary embodiment will now be described. The liquid discharge apparatus 10 according to the present exemplary embodiment has a similar configuration to that according to the first exemplary embodiment described above with reference to FIGS. 1 to 5. Mainly the differences from the first exemplary embodiment will be described below.

Figure 8:
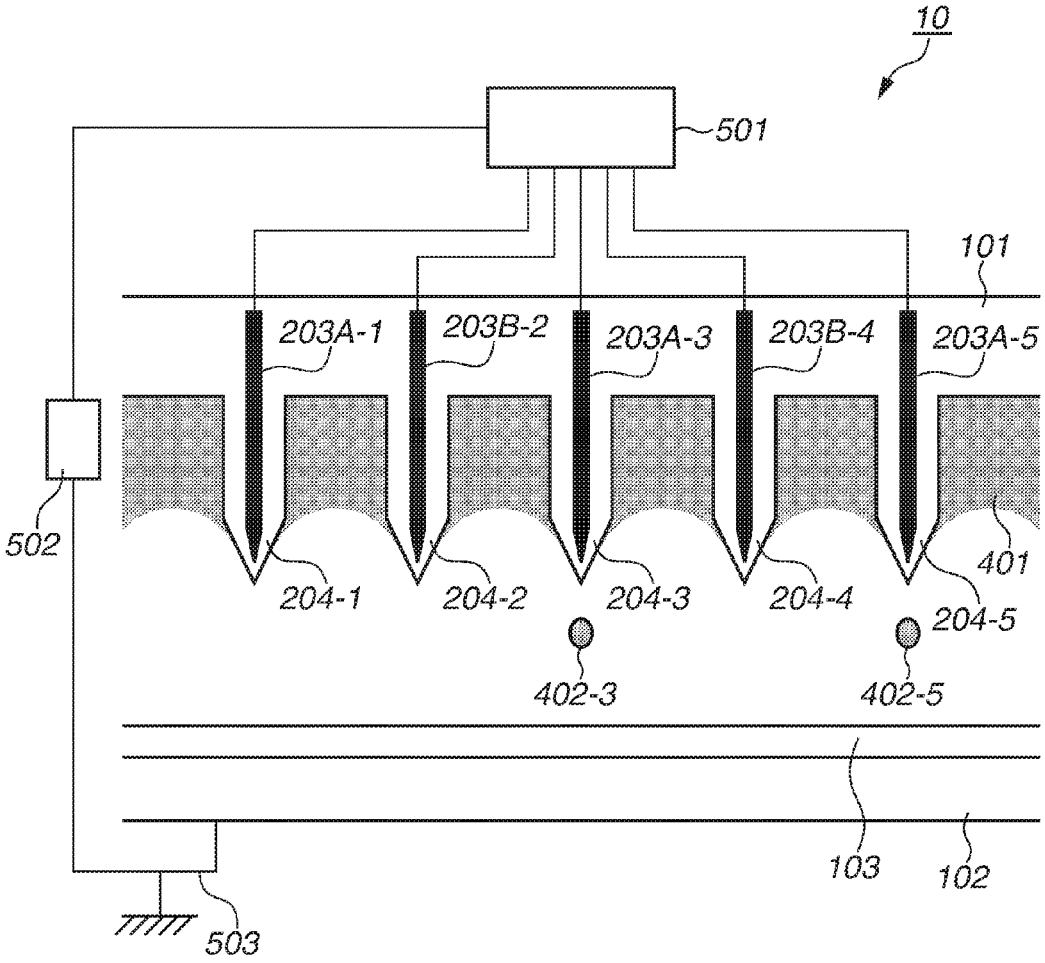
FIG. 8 illustrates a second exemplary embodiment.

FIG. 8 schematically illustrates the configuration of a part of the liquid discharge apparatus according to the second exemplary embodiment. To briefly describe the mechanism according to the present exemplary embodiment, five discharge portion electrodes 203 are illustrated in FIG. 8.

In the present exemplary embodiment, the plurality of discharge portion electrodes 203 arranged in a line is divided into groups, and each of the discharge portion electrodes 203 is assigned, by each group, in time division, as the printing electrode, which is to be driven based on the print data, or as the adjustment electrode, which is to be driven as the non-discharging electrode regardless of the print data. Specifically, the discharge portion electrodes 203 are alternately divided into groups A and B. Then, a discharge portion electrode 203A of the group A and a discharge portion electrode 203B of the group B are alternately assigned in time division as the printing electrode or the adjustment electrode. Accordingly, when the discharge portion electrode 203A is assigned as the printing electrode during one period, the discharge portion electrode 230B is assigned as the adjustment electrode during the same period. Then, during the next period, the discharge portion electrode 203A is assigned as the adjustment electrode, and the discharge portion electrode 203B is assigned as the printing electrode. At this time, the controller 501 adjusts the value of the voltage to be applied to the discharge portion electrode 203 that is assigned as the adjustment electrode, based on the voltage to be applied to the discharge portion electrode 203 adjacent to the discharge portion electrode 203 that is assigned as the adjustment electrode. Specifically, in the present exemplary embodiment, the target electrode is the discharge portion electrode 203 that is assigned as the adjustment electrode. During the period in which the discharge portion electrode 203A is assigned as the adjustment electrode, the value of the voltage to be applied to the discharge portion electrode 203A is adjusted based on the value of the voltage to be applied to the adjacent discharge portion electrode 203B, i.e., based on whether the adjacent discharge portion electrode 203B is the discharging electrode or the non-discharging electrode. During the period in which the discharge portion electrode 203B is assigned as the adjustment electrode, the value of the voltage to be applied to the discharge portion electrode 203B is adjusted based on the value of the voltage to be applied to the adjacent discharge portion electrode 203A.

The controller 501 adjusts an average value of potential differences between the discharge portion electrode 203 that is assigned as the adjustment electrode and the common electrode 102 based on the voltage to be applied to the two discharge portion electrodes 203 adjacent the target electrode. Specifically, the controller 501 adjusts the voltage to be applied to the target electrode such that the potential difference is larger in a case where one of the two discharge portion electrodes 203 adjacent to the target electrode is the discharging electrode and the other one is the discharging electrode than in a case where both of the two discharge portion electrodes 203 are the discharging electrodes.

In the state illustrated in FIG. 8, the discharge portion electrode 203A is assigned as the printing electrode and is driven based on the print data. The discharge portion electrode 203A-1 is driven as the non-discharging electrode, and the discharge portion electrodes 203A-3 and 203A-5 are driven as the discharging electrodes. The discharge portion electrodes 203B-2 and 203B-4 are assigned as the adjustment electrodes and are driven as the non-discharging electrodes regardless of the print data. The controller 501 applies predetermined values of voltages for the discharging electrode and the non-discharging electrode to the discharge portion electrode 203A driven based on the print data. Specifically, the controller 501 applies a voltage of 1300 V to the discharge portion electrodes 203A-3 and 203A-5 driven as the discharging electrodes, and applies a voltage of 1000 V to the discharge portion electrode 203A-1 driven as the non-discharging electrode. Further, the controller 501 adjusts the voltage to be applied to the discharge portion electrode 203B-2 based on the voltages to be applied to the adjacent discharge portion electrodes 203A-1 and 203A-3. Then, the controller 501 adjusts the voltage to be applied to the discharge portion electrode 203B-4 based on the voltages to be applied to the adjacent discharge portion electrodes 203A-3 and 203A-5. For example, the controller 501 can set the value of the voltage to be applied to the target discharge portion electrode 203B such that the value is larger in the case where one of the two adjacent discharge portion electrodes 203A is the discharging electrode and the other one is the non-discharging electrode than in the case where both of the two adjacent discharge portion electrodes 203A are the discharging electrodes. Specifically, the discharge portion electrode 203A-1 is the non-discharging electrode and the discharge portion electrode 203A-3 is the discharging electrode, so that the controller 501 applies a voltage of 1100 V to the discharge portion electrode 203B-2. Further, both of the discharge portion electrodes 203A-3 and 203A-5 are the discharging electrodes, so that the controller 501 applies a voltage of 900 V to the discharge portion electrode 203B-4. While there is no corresponding discharge portion electrode 203 in the state illustrated in FIG. 8, in a case where both of the adjacent discharge portion electrodes 203 are the non-discharging electrodes, the controller 501 applies a voltage of 1000 V to the discharge portion electrode 203 that is sandwiched between the non-discharging electrodes.

The voltage of 1000 V applied to the discharge portion electrode 203A-1 and the voltage of 1300 V applied to the discharge portion electrode 203A-5 cause a Coulomb force to be generated to attract the droplet 402-3 discharged from the discharge portion 204-3 toward the discharge portion electrode 203A-1 side. However, in the present exemplary embodiment, the voltage of 1000 V applied to the discharge portion electrode 203B-2 and the voltage of 900 V applied to the discharge portion electrode 203B-4 cause another Coulomb force to be generated to cancel the above-described Coulomb force, the amount of displacement of the landing position is reduced. In the state illustrated in FIG. 8, conditions are similar to those in the state illustrated in FIG. 7 according to the first exemplary embodiment, so that the amount of displacement of the landing position is 12 μm, which is smaller than the amount of displacement in the first comparative example.

Figure 9:
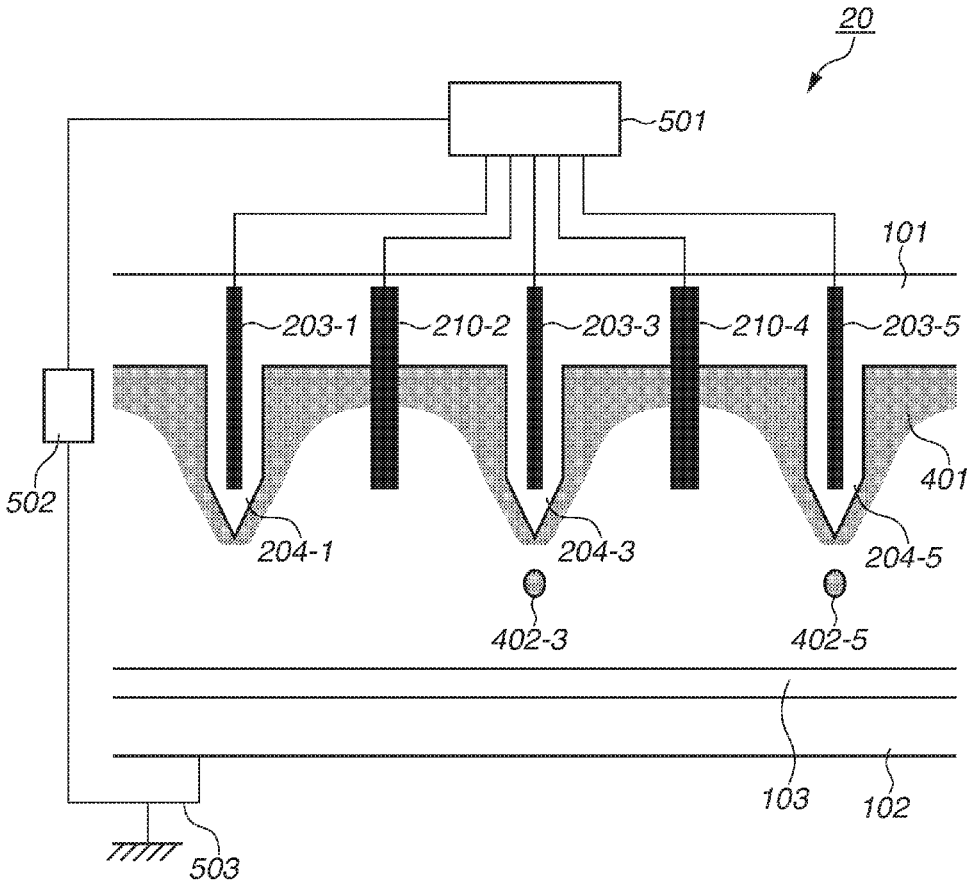
FIG. 9 illustrates a third exemplary embodiment.

A liquid discharge apparatus 20 according to a third exemplary embodiment of the present disclosure will now be described. Description of similar points of a basic configuration of the liquid discharge apparatus 20 to the liquid discharge apparatus 10 according to the first and second exemplary embodiments is omitted, and mainly a difference will be described below. FIG. 9 schematically illustrates the configuration of a part of the liquid discharge apparatus 20 according to the third exemplary embodiment. To briefly describe the mechanism according to the present exemplary embodiment, three discharge portion electrodes 203 are illustrated in FIG. 9.

While the arrangement density of the discharge portions 204 is 300 dot/inch in the first and second exemplary embodiments and the first comparative example, the arrangement density of the discharge portions 204 is 150 dot/inch in the third exemplary embodiment. Between the discharge portions 204 is placed an inter-discharge-portion electrode 210 for adjusting the Coulomb forces which act on the discharged droplet 402. The inter-discharge-portion electrode 210 is the adjustment electrode that is to be driven as the non-discharging electrode regardless of the print data.

The distance between a leading edge of the inter-discharge-portion electrode 210 and the printing medium 103 is 700 μm. The position of the leading edge of the inter-discharge-portion electrode 210 is closer to the liquid discharge head 101 side by 100 μm than the leading edge of the discharge portion 204. In the direction in which the discharge portions 204 are arranged, the width of the inter-discharge-portion electrode 210 is 20 μm. In the direction in which the printing medium 103 is conveyed, the width of the inter-discharge-portion electrode 210 is 100 μm. Further, the values of the voltages to be applied the discharge portion electrode 203 and the inter-discharge-portion electrode 210 are both controlled by the controller 501. Specifically, the controller 501 includes both a function of a discharge portion electrode control unit configured to control the value of the voltage to be applied to the discharge portion electrode 203 and a function of an inter-discharge-portion electrode control unit configured to control the value of the voltage to be applied to the inter-discharge-portion electrode 210.

The controller 501 drives each of the discharge portion electrodes 203-1, 203-3, and 203-5 based on the print data. In the state illustrated in FIG. 9, the controller 501 applies a voltage of 1000 V to drive the discharge portion electrode 203-1 as the non-discharging electrode. The controller 501 applies a voltage of 1300 V to drive the discharge portion electrodes 203-3 and 203-5 as the discharging electrodes. In the present exemplary embodiment, the controller 501 adjusts the value of the voltage to be applied to the inter-discharge-portion electrode 210 based on the voltage to be applied to the discharge portion electrode 203 adjacent to the target inter-discharge-portion electrode 210. For example, in a case where one of the discharge portion electrodes 203 adjacent to the inter-discharge-portion electrode 210-2 is the discharging electrode and the other one is the non-discharging electrode, the controller 501 adjusts the value of the voltage to be applied to the inter-discharge-portion electrode 210-2 to 1100 V. Further, in a case where both of the discharge portion electrodes 203 adjacent to an inter-discharge-portion electrode 210-4 are the discharging electrodes, the controller 501 can adjust the value of the voltage to be applied to the inter-discharge-portion electrode 210-4 to 900 V. In this way, the potential difference between the inter-discharge-portion electrode 210 and the common electrode 102 is larger in the case where one of the adjacent discharge portion electrodes 203 is the discharging electrode and the other one is the non-discharging electrode than in the case where both of the adjacent discharge portion electrodes 203 are the discharging electrodes.

Figure 10:
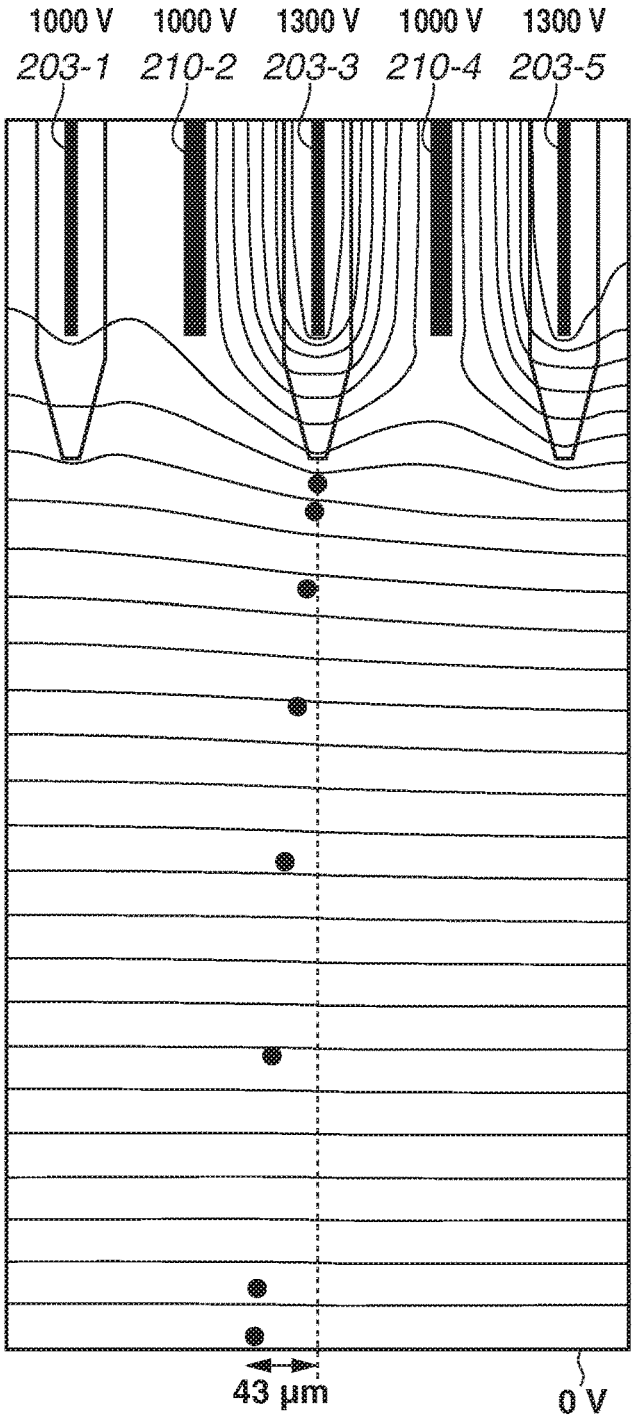
FIG. 10 illustrates a locus of a discharged droplet according to a second comparative example.

To describe an advantage of the present exemplary embodiment, a second comparative example in which the value of the voltage to be applied to the inter-discharge-portion electrode 210 is not adjusted and is set to a constant value will now be described. FIG. 10 illustrates a locus of the droplet 402-3 from the discharge to the landing which is obtained by numerical calculation in the second comparative example. In the second comparative example, the value of the voltage to be applied to the inter-discharge-portion electrode 210 is set to 1000 V. In this case, the voltage of 1000 V applied to the discharge portion electrode 203-1 and the voltage of 1300 V applied to the discharge portion electrode 203-5 cause a Coulomb force to be generated to attract the droplet 402-3 to the discharge portion electrodes 203-1. Accordingly, the amount of displacement of the droplet 402-3 from the landing position of the droplet 402-3 having traveled straight is 43 μm.

Figure 11:
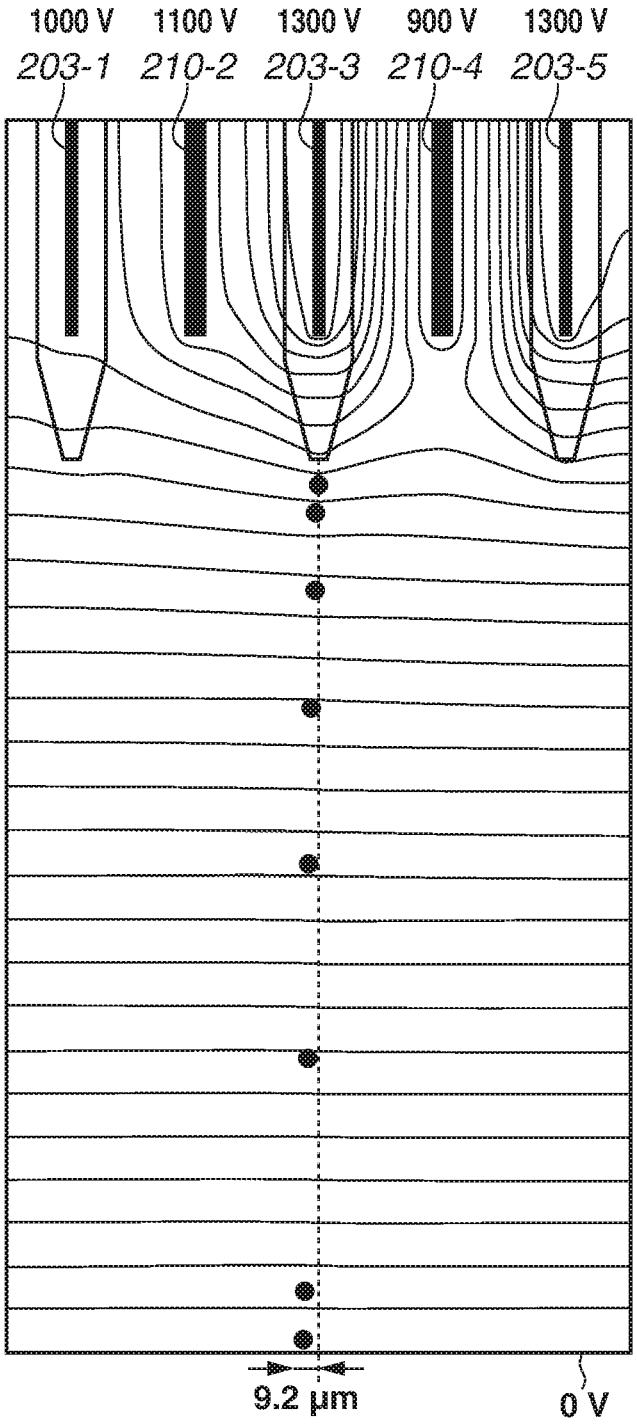
FIG. 11 illustrates a locus of a discharged droplet according to the third exemplary embodiment.

FIG. 11 illustrates a locus of the droplet 402-3 from the discharge to the landing which is obtained by numerical calculation in the third exemplary embodiment of the present disclosure. In this case, the voltage of 1100 V applied to the inter-discharge-portion electrode 210-2 and the voltage of 900 V applied to the adjustment electrode 210-4 cause a Coulomb force to be generated to cancel the Coulomb force generated by the voltage applied to the discharge portion electrode 203. Thus, it is confirmed that in the present exemplary embodiment, the amount of displacement of the droplet 402-3 from the landing position of the droplet 402-3 having traveled straight is reduced to 9.2 μm.

The following describes a liquid discharge apparatus 30 according to a fourth exemplary embodiment of the present disclosure. The liquid discharge apparatus 30 has a similar basic configuration to the configuration of the liquid discharge apparatus 20, except that the form of the inter-discharge-portion electrode 210 is different from that of the liquid discharge apparatus 20. Mainly a difference will be described below.

Figure 12:
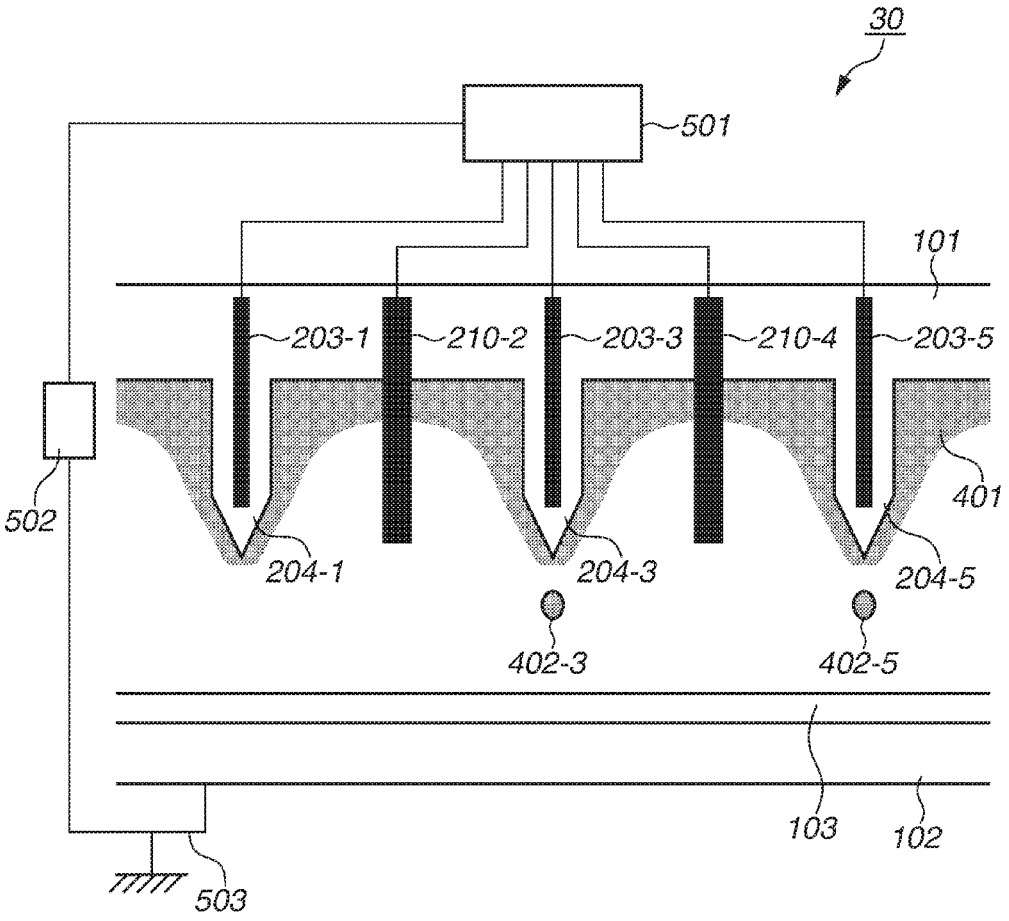
FIG. 12 illustrates a fourth exemplary embodiment.

FIG. 12 schematically illustrates a part of the liquid discharge apparatus 30 according to the fourth exemplary embodiment of the present disclosure. In the present exemplary embodiment, the leading edge of the inter-discharge-portion electrode 210 projects farther toward the common electrode 102 by 50 μm than the leading edge of the discharge portion electrodes 203. In other words, the leading edge of the inter-discharge-portion electrode 210 is closer to the common electrode 102 than the leading edge of the discharge portion electrodes 203. In this case, the inter-discharge-portion electrode 210 has a large effect of shielding an electric field, so that even if the value of the voltage to be applied to the inter-discharge-portion electrode 210 is set smaller than the value for the liquid discharge apparatus 30, the amount of displacement of the landing position is reduced. The inter-discharge-portion electrode 210 at least needs to project farther toward the common electrode 102 than the discharge portion electrodes 203. While the leading edge of the discharge portions 204 is closer to the common electrode 102 than the leading edge of the inter-discharge-portion electrode 210 in the example illustrated in FIG. 12, the inter-discharge-portion electrode 210 can project farther toward the common electrode 102 than the leading edge of the discharge portions 204.

In the present exemplary embodiment as well, the controller 501 drives the discharge portion electrode 203 based on the print data, and adjusts the value of the voltage to be applied to the inter-discharge-portion electrode 210 based on the voltage to be applied to the discharge portion electrode 203 adjacent to the target inter-discharge-portion electrode 210. Specifically, the controller 501 applies a voltage of 1000 V to drive the discharge portion electrode 203-1 as the non-discharging electrode, and applies a voltage of 1300 V to drive the discharge portion electrodes 203-3 and 203-5 as the discharging electrodes. The controller 501 applies a voltage of 1040 V to the inter-discharge-portion electrode 210-2 adjacent to the discharge portion electrodes 203 one of which is the discharging electrode and the other one of which is the non-discharging electrode. The controller 501 applies a voltage of 960 V to the inter-discharge-portion electrode 210-4 adjacent to the discharge portion electrodes 203 both of which are the discharging electrodes. While there is no corresponding inter-discharge-portion electrode 210 in FIG. 12, in a case where the discharge portion electrodes 203 at respective ends are to be driven as the non-discharging electrodes, the controller 501 applies a voltage of 1000 V to the inter-discharge-portion electrode 210.

In this way, the Coulomb force can be generated by the voltage applied to the inter-discharge-portion electrode 210 to cancel the Coulomb force which is generated by the voltages applied to the discharge portion electrodes 203-1 and 203-5 and attracts the droplet 402-3 to the discharge portion electrode 203-1 side.

Figure 13:
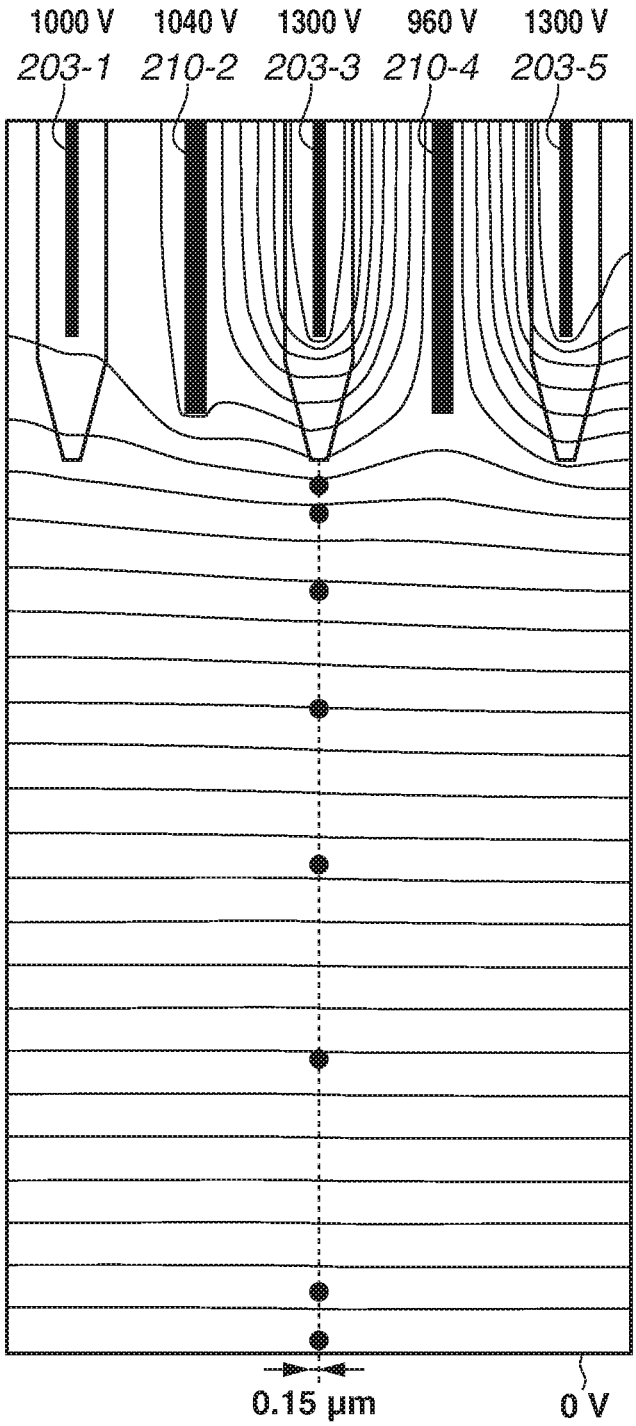
FIG. 13 illustrates a locus of a discharged droplet according to the fourth exemplary embodiment.

FIG. 13 illustrates a locus of the droplet 402-3 from the discharge to the landing which is obtained by numerical calculation in the fourth exemplary embodiment. From the numerical calculation, 0.15 μm is obtained as the amount of displacement of the droplet 402-3 from the landing position of the droplet 402-3 having traveled straight from the discharge portion 204-3, and it is confirmed that the amount of displacement of the landing position is further reduced from the amount of displacement in the third exemplary embodiment.

A fifth exemplary embodiment of the present disclosure will now be described. In the first to fourth exemplary embodiments, the voltage to be applied to the electrode that is to be driven as the non-discharging electrode is adjusted to adjust electric fields near the discharge portions 204. In the present exemplary embodiment, the voltage to be applied to the electrode that is to be driven as the discharging electrode is also adjusted in addition to the voltage to be applied to the non-discharging electrode to adjust the electric fields near the discharge portions 204. At this time, a voltage equal to or higher than the discharge threshold voltage Vt needs to be applied to the discharging electrode at the moment of the discharge of the liquid. Thus, the controller 501 changes the values of the voltages to be applied to the electrodes during a period from the discharge of the liquid to the landing of the droplet 402 onto the printing medium 103 on the common electrode 102.

Figure 14A:
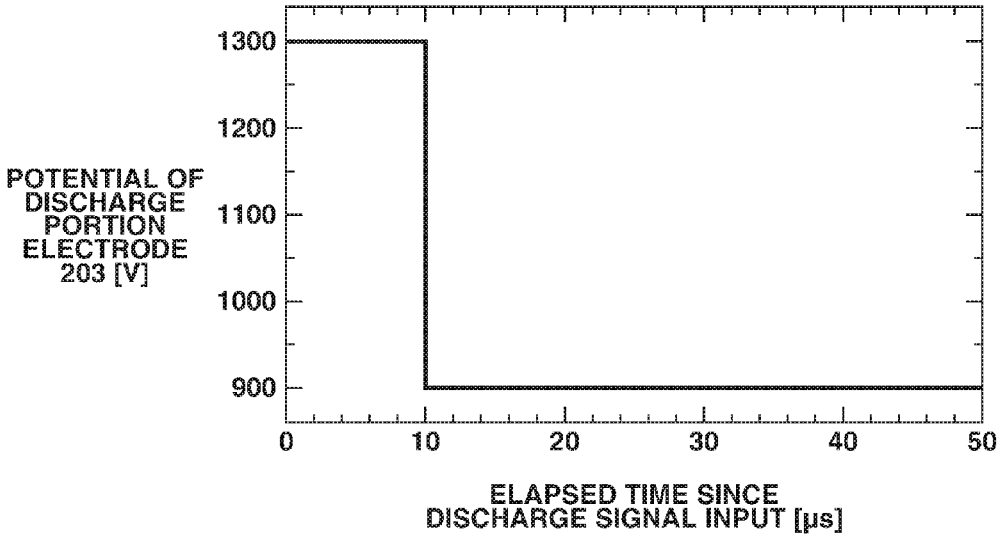
FIGS. 14A and 14B are timing charts illustrating a fifth exemplary embodiment.
Figure 14B:
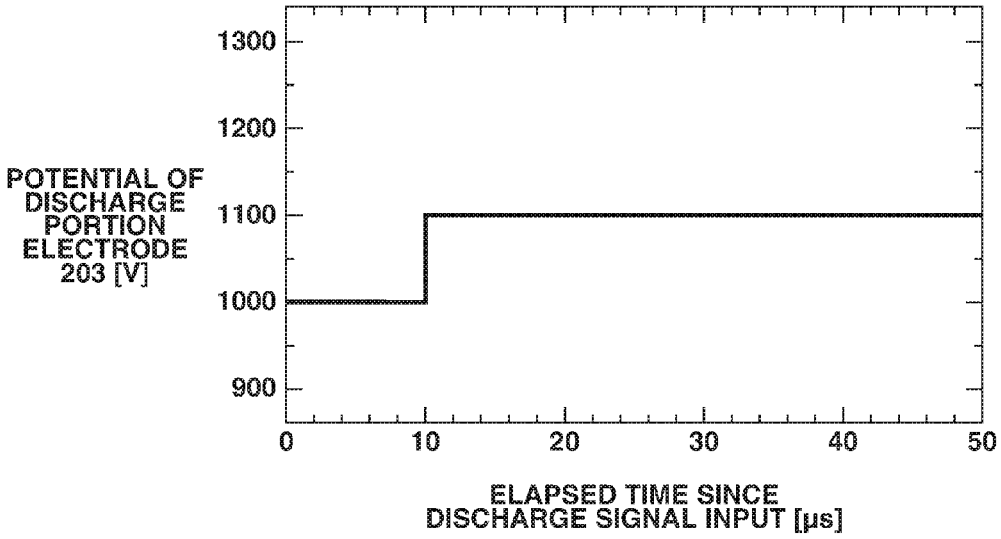

A liquid discharge apparatus according to the present exemplary embodiment has a similar configuration to that according to the first exemplary embodiment as illustrated in FIG. 5, sc that description thereof is omitted. FIGS. 14A and 14B are timing charts illustrating a method of controlling the liquid discharge apparatus according to the fifth exemplary embodiment of the present disclosure. FIG. 14A illustrates the potential of the discharge portion electrode 203 that is to be driven as the discharging electrode. FIG. 14B illustrates the potential of the discharge portion electrode 203 that is to be driven as the non-discharging electrode. The controller 501 applies a voltage equal to or higher than the discharge threshold voltage Vt, e.g., a voltage of 1300 V, to the discharge portion electrode 203 that is to be driven as the discharging electrode, based on the print data. At this time, the controller 501 applies a voltage lower than the discharge threshold voltage Vt, e.g., a voltage of 1000 V, to the discharge portion electrode 203 that is to be driven as the non-discharging electrode.

After a liquid is discharged, the controller 501 changes the values of the voltages applied to the discharging electrode and the non-discharging electrode before the discharged liquid lands onto the printing medium 103. In other words, in the present exemplary embodiment, all the printing electrodes are the target electrodes to be adjusted. Specifically, the controller 501 changes the value of the voltage to be applied to the discharging electrode from 1300 V to 900 V, and increases the value of the voltage be applied to the non-discharging electrode from 1000 V to 1100 V. In the present exemplary embodiment, the timing of changing the voltage is set to 10 μs after a discharge signal for discharging the liquid is input. Further, the value of the voltage to be applied to the non-discharging electrode is adjusted within values that are smaller than the discharge threshold voltage Vt. In this way, the potential of the discharging electrode becomes lower than the potential of the non-discharging electrode during a period from the discharge of the liquid to the landing of the discharged liquid onto the printing medium 103. Accordingly, a Coulomb force is generated to cancel a Coulomb force generated when the liquid is discharged, so that the amount of displacement of the landing position is reduced.

Figure 15:
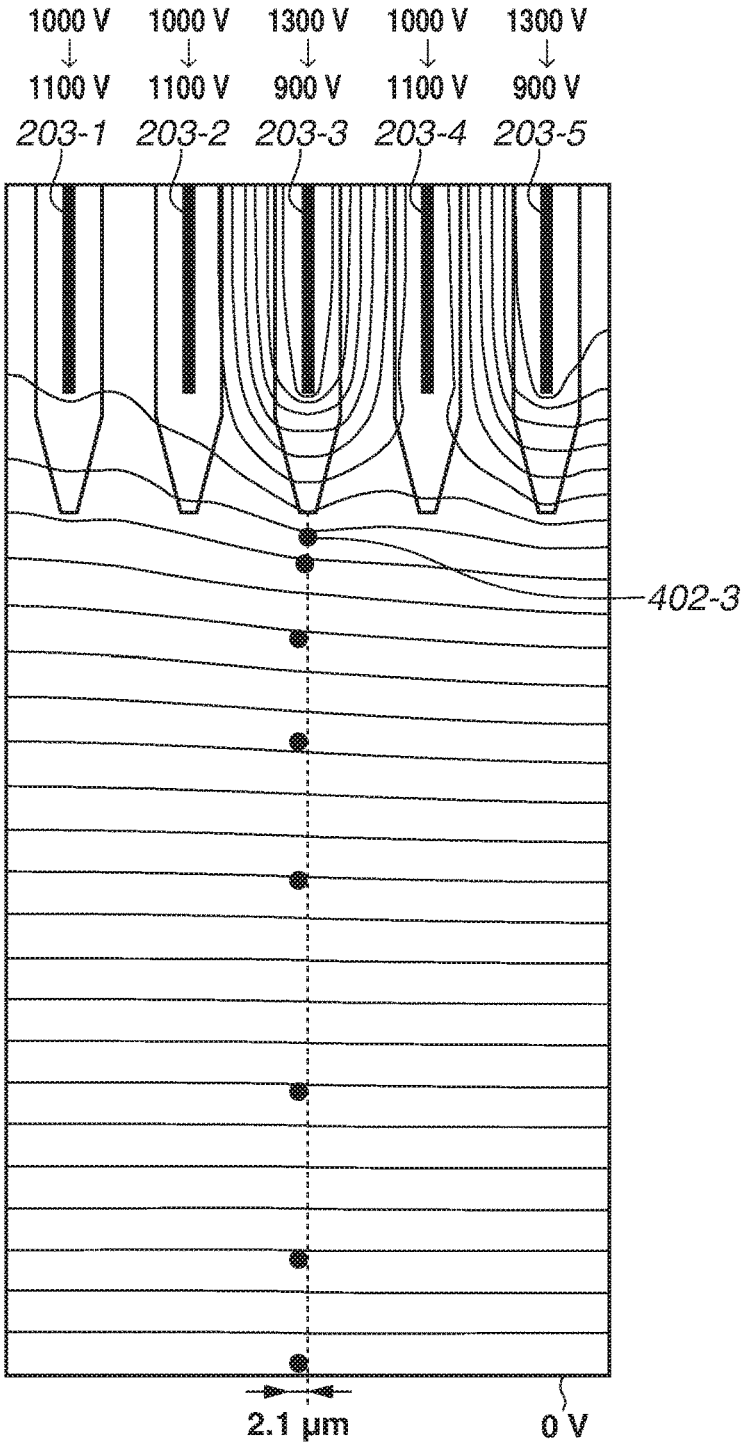
FIG. 15 illustrates a locus of a discharged droplet according to the fifth exemplary embodiment.

FIG. 15 illustrates a locus of the droplet 402-3 from the discharge to the landing which is obtained by numerical calculation in the fifth exemplary embodiment of the present disclosure. From the numerical calculation, 2.1 μm is obtained as the amount of displacement from the landing position of the droplet 402-3 having traveled straight from the discharge portion 204-3, and it is confirmed that the amount of displacement of the landing position is reduced, compared to the first comparative example illustrated in FIG. 6.

As described above, the liquid discharge apparatuses according to the first to fifth exemplary embodiments of the present disclosure control the values of the voltages to be applied to the electrodes to cancel the Coulomb force which acts on the discharged liquid so that the amount of displacement of the landing position of the droplet is reduced. Thus, the displacement of the landing position from the desired position is effectively reduced with a simple configuration.

While the present disclosure has been described with reference to exemplary embodiments, it is to be understood that the disclosure is not limited to the disclosed exemplary embodiments. Various changes which are understandable by those skilled in the art can be made to configurations and details of the disclosure without departing from the spirit of the disclosure. Further, while the exemplary embodiments describe various combinations of features of the disclosure, the features of the disclosure can be used in any combination.

Further, while the discharge portion electrode 203 and the inter-discharge-portion electrode 210 are controlled by the same controller 501 in the above-described exemplary embodiments, the exemplary embodiments of the present disclosure are not limited to the described example. For example, the discharge portion electrode control unit configured to control the discharge portion electrodes 203 and the inter-discharge-portion electrode control unit configured to control the inter-discharge-portion electrode 210 can be realized by different members.

Further, the present disclosure can also be realized as a method of controlling a liquid discharge apparatus to realize the functions of the liquid discharge apparatuses described above in the exemplary embodiments. A computer program for realizing the functions of the liquid discharge apparatuses and a computer-readable recording medium which stores such a computer program can also be provided. Further, the computer program can be distributed, for example, via a communication network.

The liquid discharge apparatuses using the electrostatic attraction method according to the exemplary embodiments of the present disclosure are capable of effectively reducing a displacement of a landing position from a desired position with a simple configuration.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-151265, filed Aug. 1, 2016, which is hereby incorporated by reference herein in its entirety.

What is claimed is:

1. A liquid discharge apparatus comprising:

a liquid discharge head including a plurality of electrodes arranged in parallel;

a common electrode positioned to face the liquid discharge head; and a control unit configured to control a voltage to be applied to each of the plurality of electrodes to control the plurality of electrodes as a discharging electrode, which is to discharge a liquid, or as a non-discharging electrode, which is to discharge no liquid, wherein the control unit adjusts a value of the voltage to be applied to a target electrode among the plurality of electrodes, so that a potential difference between the target electrode and the common electrode is larger in a case where one of the two electrodes adjacent to the target electrode is the discharging electrode and the other one is the non-discharging electrode, than in a case where both of the two electrodes adjacent to the target electrode are the discharging electrodes.

2. The liquid discharge apparatus according to claim 1, wherein the control unit determines based on print data whether each of the plurality of electrodes is to be driven as the discharging electrode or as the non-discharging electrode, and wherein the control unit adjusts a value of the voltage to be applied to the electrode that is determined to be driven as the non-discharging electrode based on the voltage to be applied to the electrode adjacent to the electrode that is determined to be driven as the non-discharging electrode.

3. The liquid discharge apparatus according to claim 1, wherein the control unit assigns in time division each of the plurality of electrodes as a printing electrode, which is to be driven as the discharging electrode or as the non-discharging electrode based on print data, or as an adjustment electrode, which is to be driven as the non-discharging electrode regardless of the print data, and wherein the control unit adjusts a value of the voltage to be applied to the adjustment electrode based on the voltage to be applied to the electrode adjacent to the adjustment electrode.

4. The liquid discharge apparatus according to claim 3, wherein the control unit adjusts the value of the voltage to be applied to the adjustment electrode so that an average value of potential differences between the adjustment electrode and the common electrode is larger in a case where one of the two electrodes adjacent to the adjustment electrode is the discharging electrode and the other one is the non-discharging electrode than in a case where both of the two electrodes adjacent to the electrode that is to be adjusted are the discharging electrodes.

5. The liquid discharge apparatus according to claim 1, wherein the plurality of electrodes includes a printing electrode, which is to be driven as the discharging electrode or as the non-discharging electrode based on print data, and an adjustment electrode, which is to be driven as the non-discharging electrode regardless of the print data, and wherein the control unit adjusts a value of the voltage to be applied to the adjustment electrode.

6. The liquid discharge apparatus according to claim 5, wherein the adjustment electrode projects farther toward the common electrode than the printing electrode.

* * * * *